US009352935B2

(12) United States Patent
Baranda et al.

(10) Patent No.: US 9,352,935 B2
(45) Date of Patent: May 31, 2016

(54) TENSION MEMBER FOR AN ELEVATOR

(75) Inventors: Pedro S. Baranda, Farmington, CT (US); Ary O. Mello, Farmington, CT (US); Hugh J. O'Donnell, Longmeadow, MA (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 1354 days.

(21) Appl. No.: 10/839,550

(22) Filed: May 5, 2004

(65) Prior Publication Data

US 2004/0206579 A1 Oct. 21, 2004

Related U.S. Application Data

(60) Division of application No. 09/218,990, filed on Dec. 22, 1998, now Pat. No. 6,739,433, which is a continuation-in-part of application No. 09/031,108, filed on Feb. 26, 1998, now Pat. No. 6,401,871.

(51) Int. Cl.
*B66B 11/08* (2006.01)
*B66B 9/00* (2006.01)
(Continued)

(52) U.S. Cl.
CPC . *B66B 7/06* (2013.01); *B66B 7/062* (2013.01); *B66B 9/00* (2013.01); *B66B 11/004* (2013.01);
(Continued)

(58) Field of Classification Search
CPC ..... D07B 1/16; D07B 1/22; B66B 11/00; B66B 11/04; B66B 11/08; B66B 7/04; B66B 7/02; B29D 29/00; F16G 1/00; F16G 1/12; F16G 1/28
USPC ..... 187/250–255, 261, 264, 266; 474/205, 474/239, 260–272; 254/312; 57/210, 223, 57/241, 258; 428/372, 373
See application file for complete search history.

(56) References Cited

U.S. PATENT DOCUMENTS 444,447 A 1/1891 Lieb
582,171 A 5/1897 Brown
(Continued)

FOREIGN PATENT DOCUMENTS

BE 501611 A 3/1951
CN 1121040 A 4/1996
(Continued)

OTHER PUBLICATIONS

ASM Handbook, vol. 1, 1990, Properties and Selection: Irons, Steels, and High-Performance Alloys, ASM Handbook Committee, pp. 283-284.*
(Continued)

*Primary Examiner* — William A Rivera
*Assistant Examiner* — Stefan Kruer
(74) *Attorney, Agent, or Firm* — Carlson, Gaskey & Olds

(57) ABSTRACT

A tension member for an elevator system has an aspect ratio of greater than one, where aspect ratio is defined as the ratio of tension member width w to thickness t (w/t). The increase in aspect ratio results in a reduction in the maximum rope pressure and an increased flexibility as compared to conventional elevator ropes. As a result, smaller sheaves may be used with this type of tension member. In a particular embodiment, the tension member includes a plurality of individual load carrying cords encased within a common layer of coating. The coating layer separates the individual cords and defines an engagement surface for engaging a traction sheave.

16 Claims, 8 Drawing Sheets

(51) Int. Cl.

| | |
|---|---|
| ***B66B 7/06*** | (2006.01) |
| ***D07B 1/22*** | (2006.01) |
| ***D07B 1/16*** | (2006.01) |
| ***D07B 1/06*** | (2006.01) |
| ***B66B 11/00*** | (2006.01) |
| ***B66B 15/04*** | (2006.01) |

(52) U.S. Cl.

CPC ..... *B66B 15/04* (2013.01); *D07B 1/0673* (2013.01); *D07B 1/22* (2013.01); *D07B 2201/2087* (2013.01); *D07B 2501/2007* (2013.01)

(56) References Cited

U.S. PATENT DOCUMENTS

| | | | | | |
|---|---|---|---|---|---|
| 975,790 | A | | 11/1910 | Pearson | |
| 1,011,423 | A | | 12/1911 | Gale, Sr. | |
| 1,035,230 | A | | 8/1912 | Pearson | |
| 1,047,330 | A | | 12/1912 | Sundh | |
| 1,132,769 | A | | 3/1915 | Gale, Sr. | |
| 1,164,115 | A | | 12/1915 | Pearson | |
| 1,475,250 | A | | 11/1923 | Sundh | |
| RE15,737 | E | | 12/1923 | Neenan | |
| 1,477,886 | A | | 12/1923 | Lewis | |
| 1,632,512 | A | | 6/1927 | Serva | |
| 1,748,100 | A | | 2/1930 | Avery | |
| 2,017,149 | A | | 10/1935 | Greening | |
| 2,326,670 | A | | 8/1943 | Patterson, Jr. | |
| 2,526,324 | A | * | 10/1950 | Bloomfield | 474/270 |
| 2,625,373 | A | | 1/1953 | Hunt | |
| 2,685,801 | A | | 8/1954 | Tishman | |
| 3,148,710 | A | | 9/1964 | Rieger et al. | |
| 3,174,585 | A | | 3/1965 | Tofanelli | |
| 3,177,733 | A | | 4/1965 | Yamano | |
| 3,279,762 | A | * | 10/1966 | Bruns | 254/266 |
| 3,395,530 | A | | 8/1968 | Campbell | 57/232 |
| 3,498,917 | A | | 3/1970 | Witter | |
| 3,820,625 | A | | 6/1974 | Balint et al. | |
| 3,824,777 | A | | 7/1974 | Riggs | 57/149 |
| 3,922,841 | A | | 12/1975 | Katsumata et al. | 57/145 |
| 3,934,482 | A | | 1/1976 | Byers | |
| 4,013,142 | A | * | 3/1977 | Hagg | 187/254 |
| 4,022,010 | A | | 5/1977 | Gladenbeck et al. | |
| 4,030,569 | A | | 6/1977 | Berkovitz | |
| 4,050,230 | A | | 9/1977 | Senoo et al. | 57/149 |
| 4,202,164 | A | | 5/1980 | Simpson et al. | 57/232 |
| 4,227,041 | A | | 10/1980 | Den et al. | |
| 4,344,278 | A | | 8/1982 | Jamison et al. | 57/232 |
| 4,388,837 | A | | 6/1983 | Bender | 74/89.2 |
| 4,402,488 | A | | 9/1983 | Berkovitz | |
| 4,422,286 | A | | 12/1983 | Simpson | |
| 4,445,593 | A | | 5/1984 | Coleman et al. | |
| 4,465,161 | A | | 8/1984 | Ohta et al. | |
| 4,481,996 | A | * | 11/1984 | De Bondt et al. | 152/451 |
| 4,519,262 | A | | 5/1985 | Le et al. | 74/89.2 |
| 4,534,163 | A | | 8/1985 | Schuerch | 57/233 |
| 4,570,753 | A | | 2/1986 | Ohta et al. | |
| 4,589,861 | A | | 5/1986 | Dodge | |
| 4,609,181 | A | | 9/1986 | Fisher et al. | 254/134.3 FT |
| 4,624,097 | A | | 11/1986 | Wilcox | |
| 4,724,929 | A | | 2/1988 | Coleman et al. | |
| 4,877,060 | A | | 10/1989 | Froment et al. | |
| 4,887,656 | A | | 12/1989 | Verbauwhede et al. | |
| 4,905,361 | A | | 3/1990 | Morishita et al. | |
| 4,947,636 | A | | 8/1990 | Sinopoli | 57/218 |
| 4,947,638 | A | | 8/1990 | Nagamine et al. | 57/212 |
| 5,025,893 | A | | 6/1991 | Saito | |
| 5,106,672 | A | | 4/1992 | Rabe | |
| 5,112,933 | A | | 5/1992 | O'Donnell et al. | 528/61 |
| 5,129,866 | A | | 7/1992 | Schanin et al. | |
| 5,149,057 | A | | 9/1992 | Meurer | |
| 5,222,919 | A | | 6/1993 | Stauder | |
| 5,361,873 | A | | 11/1994 | de Jong et al. | |
| 5,429,211 | A | | 7/1995 | Aulanko et al. | |
| 5,461,850 | A | | 10/1995 | Bruyneel et al. | |
| 5,475,973 | A | | 12/1995 | Furukawa et al. | |
| 5,507,698 | A | | 4/1996 | Kuribayashi | |
| 5,526,552 | A | | 6/1996 | De Angelis | |
| 5,566,786 | A | | 10/1996 | De Angelis et al. | |
| 5,593,366 | A | | 1/1997 | Puzik | |
| 5,605,035 | A | | 2/1997 | Pethick et al. | 57/232 |
| 5,610,217 | A | | 3/1997 | Yarnell et al. | |
| 5,651,245 | A | | 7/1997 | Damien | 57/222 |
| 5,792,294 | A | | 8/1998 | Randazzo et al. | |
| 5,845,396 | A | | 12/1998 | Altman et al. | 29/885 |
| 5,855,254 | A | | 1/1999 | Blochle | |
| 5,881,843 | A | * | 3/1999 | O'Donnell et al. | 187/254 |
| 6,138,799 | A | | 10/2000 | Schroder-Brumloop et al. | |
| 6,182,433 | B1 | * | 2/2001 | Tagawa | 57/212 |
| 6,276,120 | B1 | * | 8/2001 | Adriaensen et al. | 57/210 |
| 6,401,871 | B2 | | 6/2002 | Baranda et al. | |
| 6,440,579 | B1 | * | 8/2002 | Hauser et al. | 428/607 |
| 6,739,433 | B1 | | 5/2004 | Baranda et al. | |
| 2002/0070080 | A1 | | 6/2002 | Nakagaki et al. | |
| 2003/0192743 | A1 | | 10/2003 | Aulanko et al. | |
| 2004/0016603 | A1 | | 1/2004 | Aulanko et al. | |

FOREIGN PATENT DOCUMENTS

| | | | |
|---|---|---|---|
| DE | 1032496 | | 6/1958 |
| DE | 1777764 | U | 11/1958 |
| DE | 2136540 | A1 | 7/1971 |
| DE | 1679881 | U | 3/1972 |
| DE | 2136540 | | 2/1973 |
| DE | 2307104 | A1 | 8/1973 |
| DE | 2333120 | | 1/1975 |
| EP | 0100583 | A2 | 2/1984 |
| EP | 0228725 | A1 | 7/1987 |
| EP | 100583 | B1 | 6/1988 |
| EP | 0385277 | A2 | 9/1990 |
| EP | 0631967 | | 6/1994 |
| EP | 0710618 | A2 | 5/1996 |
| EP | 0749931 | A2 | 12/1996 |
| EP | 0846645 | B1 | 11/1997 |
| EP | 0846645 | A1 | 6/1998 |
| EP | 1056675 | A1 | 12/2000 |
| ES | 405037 | | 7/1972 |
| ES | 405037 | A | 7/1972 |
| ES | 2225925 | T | 11/1997 |
| FR | 2275400 | | 1/1976 |
| FR | 2293392 | A1 | 7/1976 |
| FR | 2823734 | A1 | 10/2002 |
| GB | 1051587 | | 12/1966 |
| GB | 1051587 | A | 12/1966 |
| GB | 1052264 | | 12/1966 |
| GB | 1052264 | A | 12/1966 |
| GB | 1182593 | | 2/1970 |
| GB | 1184997 | | 3/1970 |
| GB | 1184997 | A | 3/1970 |
| GB | 1295718 | | 11/1972 |
| GB | 1295718 | A | 11/1972 |
| GB | 1362514 | | 8/1974 |
| GB | 1362514 | A | 8/1974 |
| GB | 1401197 | | 7/1975 |
| GB | 1578858 | | 11/1980 |
| GB | 2116512 | A | 9/1983 |
| GB | 2127934 | A | 4/1984 |
| GB | 2134209 | A | 8/1984 |
| GB | 2162283 | | 1/1986 |
| GB | 2134209 | | 8/1994 |
| JP | 48-15497 | | 5/1973 |
| JP | 49-20811 | B | 5/1974 |
| JP | S42-77526 | | 5/1974 |
| JP | S49-77528 | | 5/1974 |
| JP | 59-102780 | | 6/1984 |
| JP | 1266341 | A | 10/1989 |
| JP | 1267286 | A | 10/1989 |
| JP | 3003883 | A | 1/1991 |
| JP | 5039180 | A | 2/1993 |
| JP | 5178434 | A | 7/1993 |
| JP | 6-42119 | | 11/1994 |
| JP | 7-70962 | | 3/1995 |
| JP | 7-97165 | | 4/1995 |

(56) References Cited

FOREIGN PATENT DOCUMENTS

| | | | | | |
|---|---|---|---|---|---|
| JP | 9-21084 | | | 1/1997 | |
| JP | 09021084 | A | * | 1/1997 | ..... D07B 1/16 |
| SU | 505764 | A | | 4/1976 | |
| SU | 1216120 | A | | 7/1986 | |
| WO | 9816681 | | | 4/1998 | |
| WO | 98/29326 | | | 7/1998 | |
| WO | 98/29327 | | | 7/1998 | |
| WO | 9829326 | | | 7/1998 | |
| WO | WO 98/29327 | A1 | | 7/1998 | |
| WO | WO9829326 | A1 | * | 7/1998 | ..... B66B 7/06 |

OTHER PUBLICATIONS

Brochure: "Hannover Fair: Another new idea from Conti-Tech Lifting belts for elevators", 1998, 3 pgs., ContiTech Group and Continental's Automotive Systems Group.
Chinese Office Action, Dec. 28, 2007 from counterpart Chinese Application No. CN 200510091712.X, (7 pgs), with English language translation (10 pgs).
Japanese Office Action (cited in Japanese Counterpart Application No. 2000-533617), Nov. 24, 2009, 4 pages.
U.S. Litigation (Civil Action 2:09-cv-00560-DMC-MF) regarding U.S. Pat. No. 6,739,433, Plaintiff Schindler Elevator Corporation's Invalidity Contentions, May 1, 2009, 17 pages.
Berkenhoff & Drebes GMBH, Mini-ropes and strands, Mar. 1995, pp. SCH0000034-SCH0000058.
German Litigation regarding European Patent EP1153167 and German Utility Model DE29924773 (Civil Action 4a O 372/05) (hereinafter "German Litigation 372/05"), (translation of) First Instance Decision, Oct. 26, 2006, 17 pages.
German Litigation 372/05, (translation of) Second Instance Decision, Apr. 24, 2008, 30 pages.
German Litigation 372/05, (translation of) Plaintiffs Supreme Court Appeal Brief, Oct. 1, 2008, 16 pages.
German Litigation, 372/05, (translation of) Plaintiffs Additional Supreme Court Brief, Mar. 9, 2009, 4 pages.
German Litigation regarding German Utility Model DE29924776 (Civil Action 4a O 462/05) (hereinafter "German Litigation 462/05"), (translation of) First Instance Decision, Oct. 26, 2006, 13 pages.
German Litigation 462/05, (translation of) Second Instance Decision, Apr. 24, 2008, 14 pages.
German Litigation regarding German Utility Model DE29924775 (Civil Action 4a O 401/05) (hereinafter "German Litigation 401/05"), (translation of) Plaintiffs Complaint, Aug. 23, 2005, 25 pages.
German Litigation 401/05, (translation of) Defendant's Answer, Mar. 10, 2006, 10 pages.
German Litigation 401/05, (translation of) Defendant's Brief of Aug. 8, 2006, 31 pages.
German Litigation regarding German Utility Model DE29924774 (Civil Action 4a O 463/05) (hereinafter "German Litigation 463/05") which was split from German Litigation 401/05, (translation of) Defendant's Answer, Jan. 23, 2006, 13 pages.
German Litigation 463/05, (translation of) Plaintiffs Brief, May 29, 2006, 27 pages.
German Litigation 463/05, (translation of) Defendant's Brief, Aug. 14, 2006, 26 pages.
Opposition of European Patent EP 1 060 305 B1 (hereinafter EP'305 Opposition), (translation of) Opponents Request for Opposition of Apr. 11, 2006.
EP'305 Opposition, (translation of) Opponents Additional Brief of Oct. 27, 2006.
EP'305 Opposition, (translation of) Opponents Additional Brief of Dec. 20, 2006.
EP'305 Opposition, Patentee's Observations of Jun. 11, 2007.
EP'305 Opposition, (translation of) Intervenors Notice of Intervention of Feb. 22, 2008.
EP'305 Opposition, Patentee's Observations of Dec. 23, 2008.
Hoxter Arntz-Optibel-Gruppe (Editer), "Keilriernen, eine Monografie", Essen, Germany, 1972, Verlag Ernst Heyer (Publisher).
Karl-Heinz Decker, "Maschinenelernente, Gestaltung and Berechnung", Munich, Germany, 1995, Carl_Henser-Verlag (Publisher).
Gustav Niemen, "Maschinenelemente", Berlin, Germany, 1986, Springer-Verlag (Publisher).
European Commitee for Standardization, "European Standard EN81-1, Safety Rules for the Construction and Installation of Lifts, Part 1: Electric Lifts", various pages (1-5,14-16, 55, 56 and 198), Feb. 1998, Brussels, Belgium.
Cancellation Proceeding regarding German Utility Model DE 299 24 760 (hereinafter "DE '760 Cancellation"), (translation of) Notice of Request for Cancellation of Jan. 25, 2006 (which includes Request for Cancellation of Jan. 16, 2006), 18 pages.
DE '760 Cancellation, (translation of) Decision by German Patent Office of Sep. 9, 2009, 10 pages.
Cancellation Proceeding regarding German Utility Model DE 299 24 761 (hereinafter "DE '761 Cancellation"), (translation of) Notice of Request for Cancellation of Jan. 25, 2006 (which includes Request for Cancellation of Jan. 16, 2006), 18 pages.
DE '761 Cancellation, (translation of) Petitioner's Supplemental Brief of Aug. 3, 2007, 13 pages.
DE '761 Cancellation, (translation of) Petitioner's Supplemental Brief of Jan. 30, 2008, 8 pages.
DE '761 Cancellation, (translation of) Patentee's Brief of Feb. 13, 2008, 8 pages.
DE '761 Cancellation, (translation of) Decision by German Patent Office of Apr. 16, 2008, 14 pages.
Opposition of European Patent EP 1 153 167 B1 (hereinafter EP '167 Opposition), (translation of) Opponents Request for Opposition of Jul. 28, 2006.
EP '167 Opposition, Patentee's Observations of Oct. 19, 2007.
EP '167 Opposition, Decision by EPO Opposition Division of Sep. 12, 2008.
EP '167 Opposition, (translation of) Opponent's Grounds of Appeal of Jan. 21, 2009.
EP '167, (translation of) Assumed Infringer's Grounds of Appeal of Jan. 22, 2009.
EP '167, Patentee's Response to Grounds of Appeal of Sep. 7, 2009.
Spanish Litigation (Civil Action 522/2007-1) regarding various European patents (EP1153167,EP1060305,EP1066213,EP1140689) (hereinafter "Spanish Litigation"), (translation of) Plaintiffs Complaint, Nov. 13, 2007, 54 pages.
Spanish Litigation, (translation of) Document 10 referred to in above Plaintiffs Complaint, Nov. 13, 2007, 36 pages.
Spanish Litigation, (translation of) Document 11 referred to in above Plaintiffs Complaint, Nov. 13, 2007, 29 pages.
Spanish Litigation, (translation of) Document 14 referred to in above Plaintiffs Complaint, Nov. 2007, 53 pages.
Spanish Litigation, (translation of) Document 30 dated Jun. 30, 2008, referred to in Defendant's Answer, Jul. 7, 2008, 46 pages.
Spanish Litigation, (translation of) Document 31 dated Jul. 3, 2008, referred to in Defendant's Answer, Jul. 7, 2008, 44 pages.
Spanish Litigation, (translation of) Plaintiffs Final Conclusions dated Nov. 2, 2009, 86 pages.
Schlomann-Oldenbourg, Illustrierte Technische Worterbucheh, Band 2: Die Elektrotechnik, Munchen and Berlin, 4 pages.
Feyrer, Klaus, Drahtseile, 1994, 3 pages, Mit 271 Abbildungen, Springer-Verlag, Berlin Heidelberg, New York.
Vulkollan, Angst + Pfister, 12 pages, Zurich.
Cancellation Proceeding regarding German Utility Model DE29924773 (hereinafter "DE '773 Cancellation"), (translation of) Notice of Request for Cancellation of Jan. 25, 2006 (which includes Request for Cancellation of Jan. 16, 2006), 15 pages.
Cancellation Proceeding regarding German Utility Model DE29924774 (hereinafter "DE '774 Cancellation"), (translation of) Notice of Request for Cancellation of Jan. 25, 2006 (which includes Request for Cancellation of Jan. 19, 2006), 15 pages.
DE '774 Cancellation, (translation of) Petitioner's Supplemental Brief, Sep. 28, 2006, 19 pages.

(56) References Cited

OTHER PUBLICATIONS

Cancellation Proceeding regarding German Utility Model DE29924775 (hereinafter "DE '775 Cancellation"), (translation of) Notice of Request for Cancellation of Jan. 25, 2006 (which includes Request for Cancellation of Jan. 19, 2006), 16 pages.
DE '775 Cancellation, (translation of) Petitioner's Supplemental Brief, Sep. 22, 2006, 21 pages.
Cancellation Proceeding regarding German Utility Model DE29924776 (hereinafter "DE '776 Cancellation"), (translation of) Notice of Request for Cancellation of Jan. 25, 2006 (which includes Request for Cancellation of Jan. 16, 2006), 15 pages.
DE '776 Cancellation, (translation of) Petitioner's Supplemental Brief of Oct. 11, 2006, 23 pages.
VDI 2758, Verein Deutscher Ingenieure, (Jun. 1993, revised Jan. 2001), 65 pages, Beuth Verlag GmbH Berlin, Dusseldorf.
Italian Litigation (Civil Action 74377/2006) regarding various European patents and applications (EP1056675,EP1060305,EP1066213,EP1140689,EP1153167, EP1169256,EP1208265,EP1360370,EP1427661,EP1567440, EP1568646,EP1568647,EP1580157,EP1599406,EP1631517, EP1640307,EP1642854,EP1671913,EP1676807 and EP1725375) (hereinafter "Italian Litigation"), (translation of) Plaintiffs Complaint, Nov. 24, 2006, 20 pages.
Italian Litigation, (translation of) Plaintiffs First Technical Brief, Jul. 28, 2008, 82 pages.
Italian Litigation, (translation of) Defendant's Second Technical Brief, Jan. 9, 2009, 126 pages.
Italian Litigation, (translation of) Plaintiffs Third Technical Brief, Apr. 30, 2009, 65 pages.
Japanese Office Action (cited in Japanese Counterpart Application No. 2000-589783), Aug. 26, 2009, 4 pages.
Bekaert, Steel Cord Catalogue, 1987, pp. 92-111.
Bhowmick & Stephens, Handbook of Elastomers; 1988, pp. 375-407.
Luerger, Encyclopaedia of Engineering, pp. 77-78.
Apel & Nuenninghoff, Improving the Properties of Heavy-Duty Ropes by Optimizing the Roope Configuration—Part 1; 1982; p. 645.
Shitkow, Drahtseile, 1957, pp. 208-211.
Dubbel, Pocket guide for Mechanical Engineers, 1983; pp. 441-442.
Pessina, Manuale delle Cinghie di Transmissione, 1994, pp. 89, 104, 105-107.
Milan Court of Law, Division specializing in industrial Property, I.J. Dr. Tavassi—R.G. 74377/06; Schindler Spa v Otis Elevator Company; Official Technical Consultancy Report dated May 16, 2011.
Mercantile Court No. 5 of Barcelona, Spain; Ordinary Proceedings 522/07-1; Judgment dated Jun. 7, 2011.

* cited by examiner

TENSION MEMBER FOR AN ELEVATOR

CROSS REFERENCE TO RELATED APPLICATIONS

This is a divisional of U.S. patent application Ser. No. 09/218,990, filed Dec. 22, 1998, now U.S. Pat. No. 6,739,433 which is a continuation-in-part of U.S. Ser. No. 09/031,108 filed Feb. 26, 1998, now U.S. Pat. No. 6,401,871 the entirety of which is incorporated herein by reference.

TECHNICAL FIELD

The present invention relates to elevator systems, and more particularly to tension members for such elevator systems.

BACKGROUND OF THE INVENTION

A conventional traction elevator system includes a car, a counterweight, two or more ropes interconnecting the car and counterweight, a traction sheave to move the ropes, and a machine to rotate the traction sheave. The ropes are formed from laid or twisted steel wire and the sheave is formed from cast iron. The machine may be either a geared or gearless machine. A geared machine permits the use of higher speed motor, which is more compact and less costly, but requires additional maintenance and space.

Although conventional round steel ropes and cast iron sheaves have proven very reliable and cost effective, there are limitations on their use. One such limitation is the traction forces between the ropes and the sheave. These traction forces may be enhanced by increasing the wrap angle of the ropes or by undercutting the grooves in the sheave. Both techniques reduce the durability of the ropes, however, as a result of the increased wear (wrap angle) or the increased rope pressure (undercutting). Another method to increase the traction forces is to use liners formed from a synthetic material in the grooves of the sheave. The liners increase the coefficient of friction between the ropes and sheave while at the same time minimizing the wear of the ropes and sheave.

Another limitation on the use of round steel ropes is the flexibility and fatigue characteristics of round steel wire ropes. Elevator safety codes today require that each steel rope have a minimum diameter d ($d_{min}$=8 mm for CEN, $d_{min}$=9.5 mm (⅜") for ANSI) and that the D/d ratio for traction elevators be greater than or equal to forty ($D/d \geq 40$), where D is the diameter of the sheave. This results in the diameter D for the sheave being at least 320 mm (380 mm for ANSI). The larger the sheave diameter D, the greater torque required from the machine to drive the elevator system.

Another drawback of conventional round ropes is that the higher the rope pressure, the shorter the life of the rope. Rope pressure ($P_{rope}$) is generated as the rope travels over the sheave and is directly proportional to the tension (F) in the rope and inversely proportional to the sheave diameter D and the rope diameter d ($P_{rope} \approx F/(Dd)$). In addition, the shape of the sheave grooves, including such traction enhancing techniques as undercutting the sheave grooves, further increases the maximum rope pressure to which the rope is subjected.

The above art notwithstanding, scientists and engineers under the direction of Applicants' Assignee are working to develop more efficient and durable methods and apparatus to drive elevator systems.

DISCLOSURE OF THE INVENTION

According to the present invention, a tension member for an elevator has an aspect ratio of greater than one, where aspect ratio is defined as the ratio of tension member width w to thickness t (Aspect Ratio=w/t).

A principal feature of the present invention is the flatness of the tension member. The increase in aspect ratio results in a tension member that has an engagement surface, defined by the width dimension, that is optimized to distribute the rope pressure. Therefore, the maximum pressure is minimized within the tension member. In addition, by increasing the aspect ratio relative to a round rope, which has an aspect ratio equal to one, the thickness of the tension member may be reduced while maintaining a constant cross-sectional area of the tension member.

According further to the present invention, the tension member includes a plurality of individual load carrying cords encased within a common layer of coating. The coating layer separates the individual cords and defines an engagement surface for engaging a traction sheave.

As a result of the configuration of the tension member, the rope pressure may be distributed more uniformly throughout the tension member. As a result, the maximum rope pressure is significantly reduced as compared to a conventionally roped elevator having a similar load carrying capacity. Furthermore, the effective rope diameter 'd' (measured in the bending direction) is reduced for the equivalent load bearing capacity. Therefore, smaller values for the sheave diameter 'D' may be attained without a reduction in the D/d ratio. In addition, minimizing the diameter D of the sheave permits the use of less costly, more compact, high speed motors as the drive machine without the need for a gearbox.

In a particular embodiment of the present invention, the individual cords are formed from strands of metallic material. By incorporating cords having the weight, strength, durability and, in particular, the flexibility characteristics of appropriately sized and constructed materials into the tension member of the present invention, the acceptable traction sheave diameter may be further reduced while maintaining the maximum rope pressure within acceptable limits. As stated previously, smaller sheave diameters reduce the required torque of the machine driving the sheave and increase the rotational speed. Therefore, smaller and less costly machines may be used to drive the elevator system.

In a further particular embodiment of the present invention, a traction drive for an elevator system includes a tension member having an aspect ratio greater than one and a traction sheave having a traction surface configured to receive the tension member. The tension member includes an engagement surface defined by the width dimension of the tension member. The traction surface of the sheave and the engagement surface are complementarily contoured to provide traction and to guide the engagement between the tension member and the sheave. In an alternate configuration, the traction drive includes a plurality of tension members engaged with the sheave and the sheave includes a pair of rims disposed on opposite sides of the sheave and one or more dividers disposed between adjacent tension members. The pair of rims and dividers perform the function of guiding the tension member to prevent gross alignment problems in the event of slack rope conditions, etc.

In a still further embodiment, the traction surface of the sheave is defined by a material that optimizes the traction forces between the sheave and the tension member and minimizes the wear of the tension member. In one configuration, the traction surface is integral to a sheave liner that is disposed on the sheave. In another configuration, the traction surface is defined by a coating layer that is bonded to the traction sheave. In a still further configuration, the traction sheave is formed from the material that defines the traction surface.

Although described herein as primarily a traction device for use in an elevator application having a traction sheave, the tension member may be useful and have benefits in elevator applications that do not use a traction sheave to drive the tension member, such as indirectly roped elevator systems, linear motor driven elevator systems, or self-propelled elevators having a counterweight. In these applications, the reduced size of the sheave may be useful in order to reduce space requirements for the elevator system. The foregoing and other objects, features and advantages of the present invention become more apparent in light of the following detailed description of the exemplary embodiments thereof, as illustrated in the accompanying drawings.

BEST MODE FOR CARRYING OUT THE INVENTION

Figure 1:
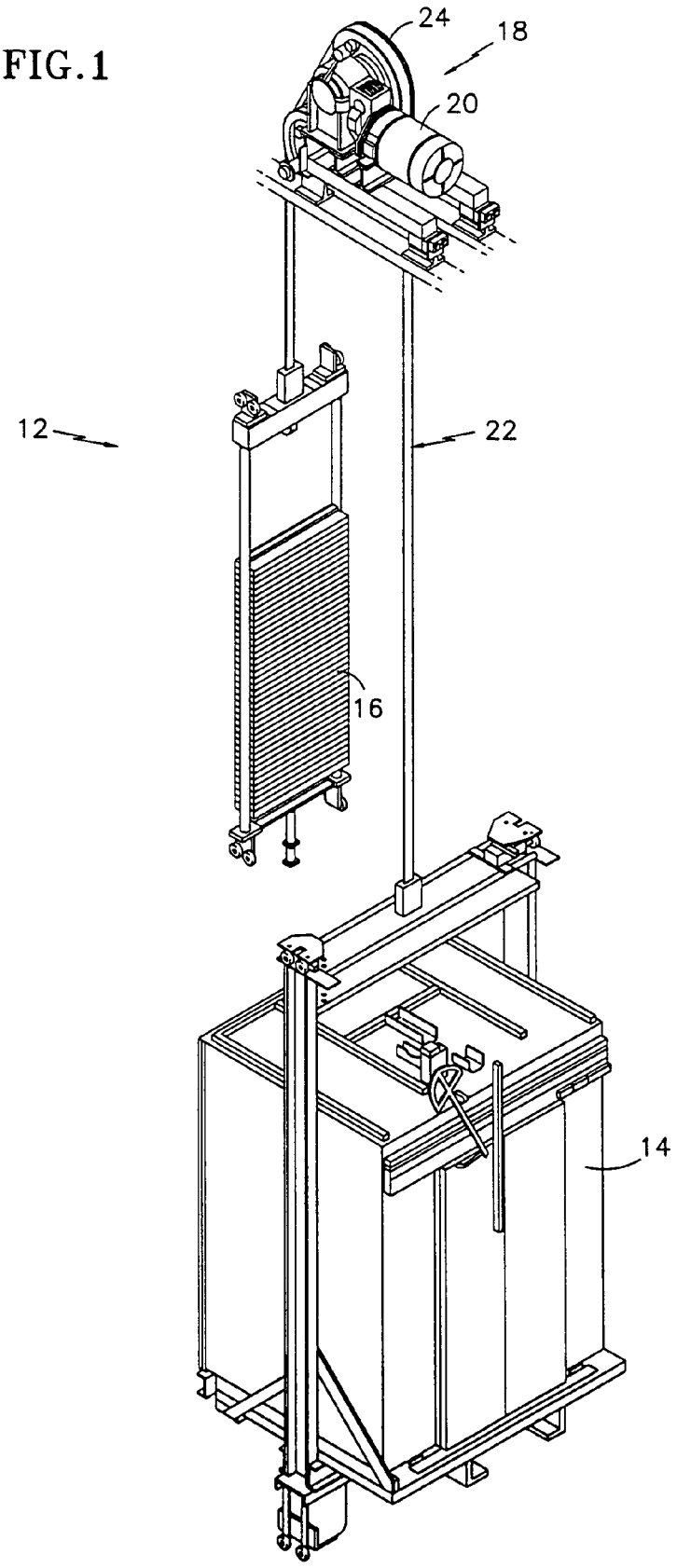
FIG. 1 is perspective view of an elevator system having a traction drive according to the present invention.

Illustrated in FIG. 1 is a traction elevator system 12. The elevator system 12 includes a car 14, a counterweight 16, a traction drive 18, and a machine 20. The traction drive 18 includes a tension member 22, interconnecting the car 14 and counterweight 16, and a traction sheave 24. The tension member 22 is engaged with the sheave 24 such that rotation of the sheave 24 moves the tension member 22, and thereby the car 14 and counterweight 16. The machine 20 is engaged with the sheave 24 to rotate the sheave 24. Although shown as an geared machine 20, it should be noted that this configuration is for illustrative purposes only, and the present invention may be used with geared or gearless machines.

Figure 2:
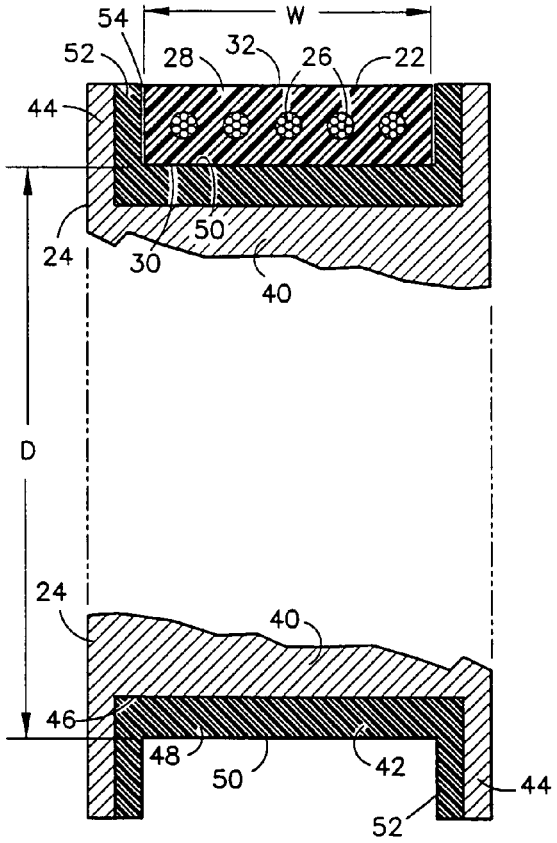
FIG. 2 is a sectional, side view of the traction drive, showing a tension member and a sheave.

The tension member 22 and sheave 24 are illustrated in more detail in FIG. 2. The tension member 22 is a single device that integrates a plurality of cords 26 within a common coating layer 28. Each of the cords 26 is formed from preferably seven twisted strands, each made up of seven twisted metallic wires. In a preferred embodiment of the invention a high carbon steel is employed. The steel is preferably cold drawn and galvanized for the recognized properties of strength and corrosion resistance of such processes. The coating layer is preferably a polyurethane material which is ether based and includes a fire retardant composition.

Figure 6:
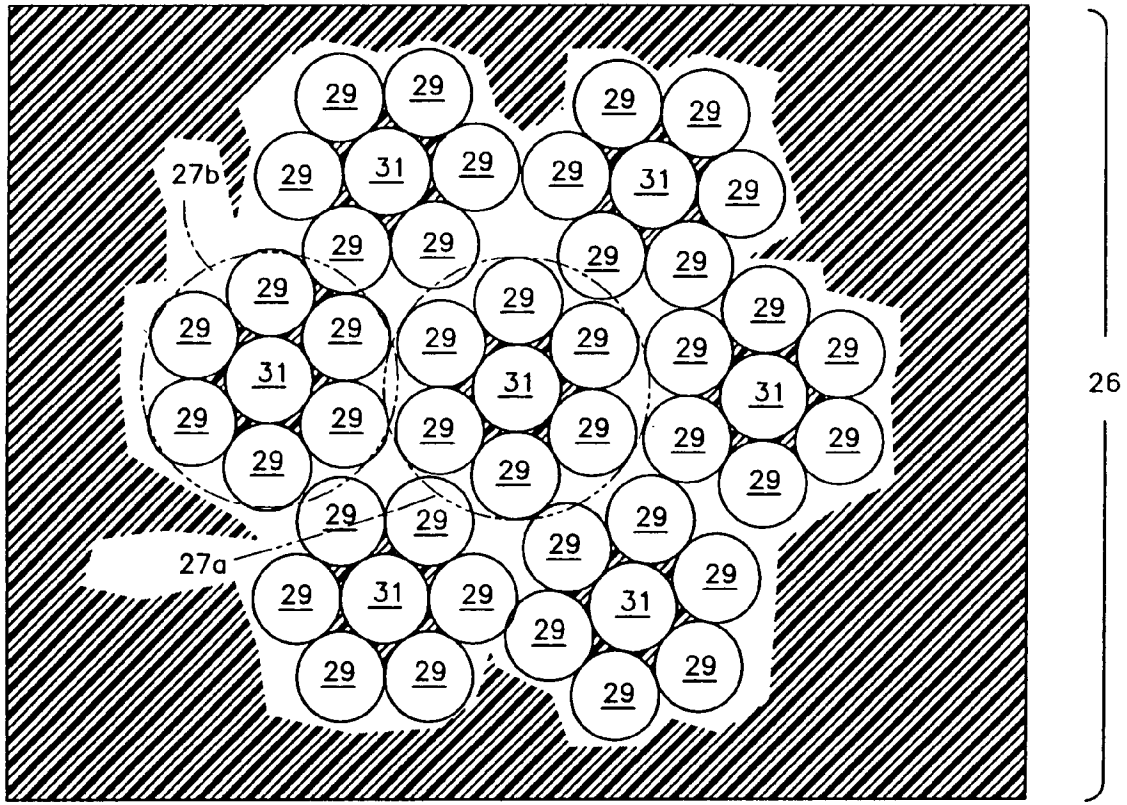
FIG. 6 is a magnified cross sectional view of a single cord of the invention having six strands twisted around a central stand.
Figure 6A:
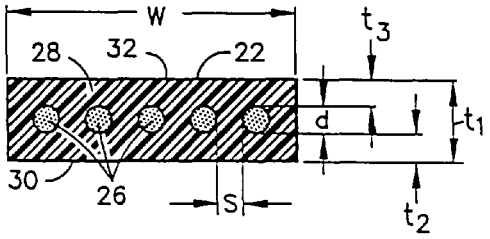
Figure 6B:
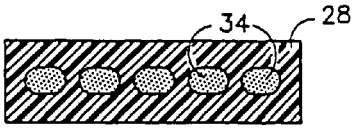
Figure 6C:
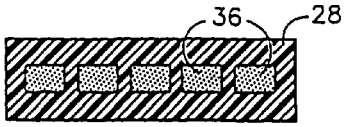
Figure 6D:
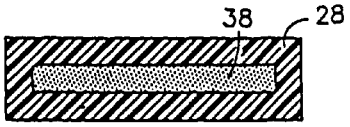

In a preferred embodiment, referring to FIG. 6, each strand 27 of a cord 26 comprises seven wires with six of the wires 29 twisted around a center wire 31. Each cord 26, comprises one strand 27*a* which is centrally located and six additional outer strands 27*b* that are twisted around the central strand 27*a*. Preferably, the twisting pattern of the individual wires 29 that form the central strand 27*a* are twisted in one direction around central wire 31 of central strand 27*a* while the wires 29 of outer strands 27*b* are twisted around the central wire 31 of the outer strands 27*b* in the opposite direction. Outer strands 27*b* are twisted around central strand 27*a* in the same direction as the wires 29 are twisted around center wire 31 in strand 27*a*. For example, the individual strands in one embodiment comprise the central wire 31, in center strand 27*a*, with the six twisted wires 29 twisting clockwise; the wires 29 in the outer strands 27*b* twisting counterclockwise around their individual center wires 31 while at the cord 26 level the outer strands 27*b* twist around the central strand 27*a* in the clockwise direction. The directions of twisting improve the characteristics of load sharing in all of the wires of the cord.

It is important to the success of the invention to employ wire 29 of a very small size. Each wire 29 and 31 are less than 0.25 millimeters in diameter and preferably is in the range of about 0.10 millimeters to 0.20 millimeters in diameter. In a particular embodiment, the wires are of a diameter of 0.175 millimeters in diameter. The small sizes of the wires preferably employed contribute to the benefit of the use of a sheave of smaller diameter. The smaller diameter wire can withstand the bending radius of a smaller diameter sheave (around 100 millimeters in diameter) without placing too much stress on the strands of the flat rope. Because of the incorporation of a plurality of small cords 26, preferably about 1.6 millimeters in total diameter in this particular embodiment of the invention, into the flat rope elastomer, the pressure on each cord is significantly diminished over prior art ropes. Cord pressure is decreased at least as $n^{-1/2}$ with n being the number of parallel cords in the flat rope, for a given load and wire cross section.

Figure 7:
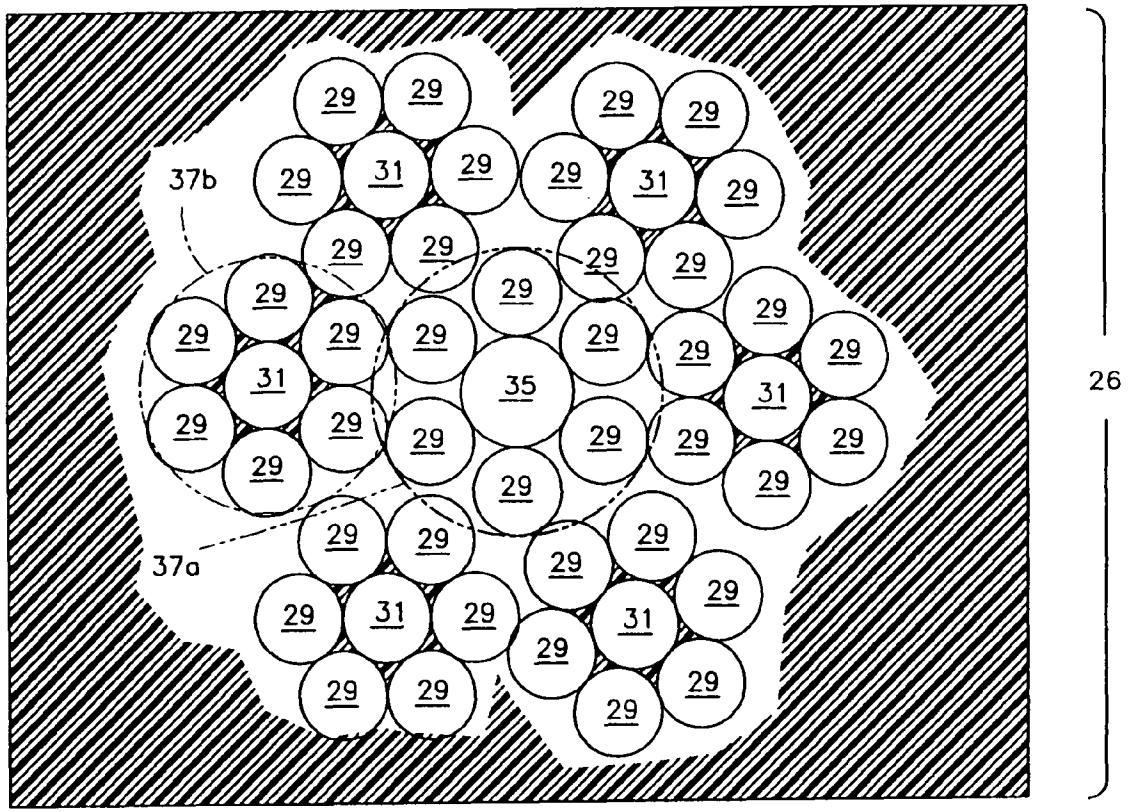
FIG. 7 is a magnified cross sectional view of an alternate single cord of the invention.

In an alternate embodiment, referring to FIG. 7, the center wire 35 of the center strand 37*a* of each cord 26 employs a larger diameter. For example, if the wires 29 of the previous embodiment (0.175 millimeters) are employed, the center wire 35 of the center strand only of all cords would be about 0.20-0.22 millimeters in diameter. The effect of such a center wire diameter change is to reduce contact between wires 29 surrounding wire 35 as well as to reduce contact between strands 37*b* which are twisted around strand 37*a*. In such an embodiment the diameter of cord 26 will be slightly greater than the previous example of 1.6 millimeters.

Figure 8:
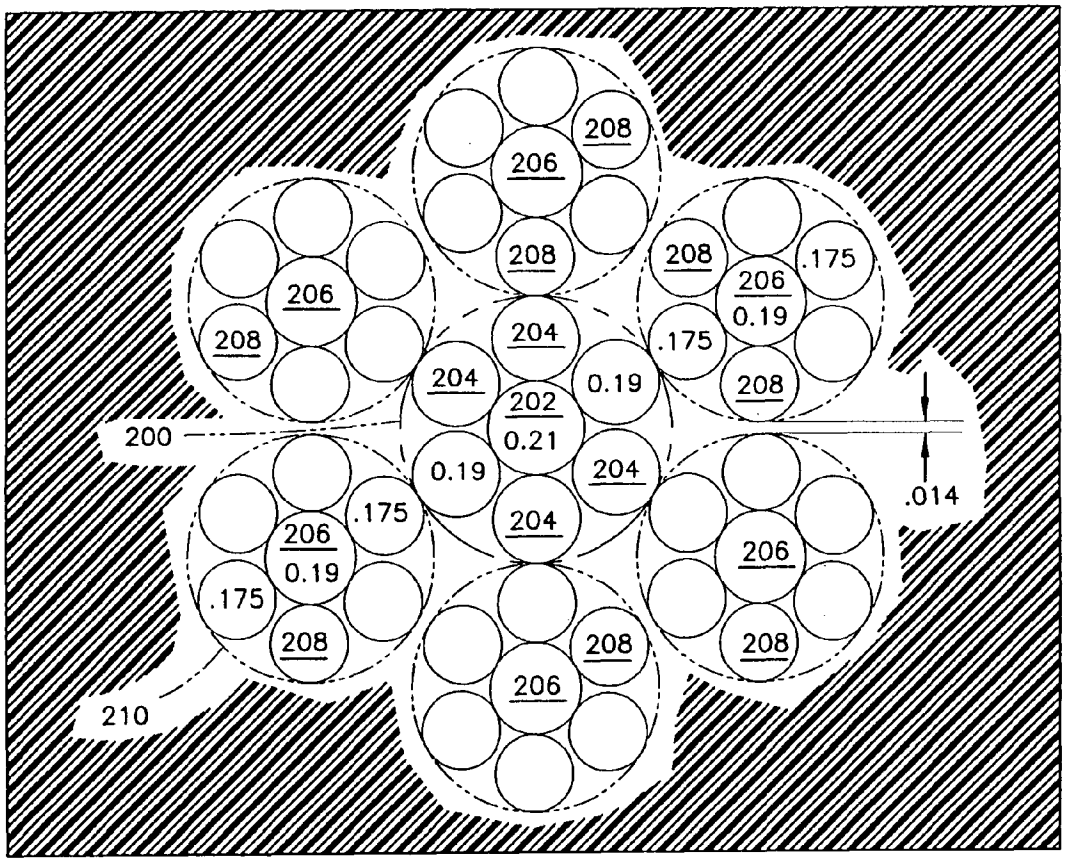
FIG. 8 is a magnified cross sectional view of another alternate embodiment of the invention.

In a third embodiment of the invention, referring to FIG. 8, the concept of the second embodiment is expanded to further reduce wire-to-wire and strand-to-strand contact. Three distinct sizes of wires are employed to construct the cords of the invention. In this embodiment the largest wire is the center wire 202 in the center strand 200. The intermediate diameter wires 204 are located around the center wire 202 of center strand 200 and therefore makeup a part of center strand 200. This intermediate diameter wire 204 is also the center wire 206 for all outer strands 210. The smallest diameter wires employed are numbered 208. These wrap each wire 206 in each outer strand 210. All of the wires in the embodiment are still less than 0.25 mm in diameter. In a representative embodiment, wires 202 may be 0.21 mm; wires 204 may be 0.19 mm; wires 206 may be 0.19 mm; and wires 208 may be 0.175 mm. It will be appreciated that in this embodiment wires 204 and 206 are of equivalent diameters and are numbered individually to provide locational information only. It is noted that the invention is not limited by wires 204 and 206 being identical in diameter. All of the diameters of wires provided are for example only and could be rearranged with the joining principle being that contact among the outer wires of the central strand is reduced; that contact among the outer wires of the outer strands is reduced and that contact among the outer strands is reduced. In the example provided, (only for purpose of example) the space obtained between the outer wires of outer strands is 0.014 mm.

The cords 26 are equal length, are approximately equally spaced widthwise within the coating layer 28 and are arranged linearly along the width dimension. The coating layer 28 is formed from a polyurethane material, preferably a thermoplastic urethane, that is extruded onto and through the plurality of cords 26 in such a manner that each of the individual cords 26 is restrained against longitudinal movement relative to the other cords 26. Transparent material is an alternate embodiment which may be advantageous since it facilitates visual inspection of the flat rope. Structurally, of course, the color is irrelevant. Other materials may also be used for the coating layer 28 if they are sufficient to meet the required functions of the coating layer: traction, wear, transmission of traction loads to the cords 26 and resistance to environmental factors. It should further be understood that if other materials are used which do not meet or exceed the mechanical properties of a thermoplastic urethane, then the additional benefit of the invention of dramatically reducing sheave diameter may not be fully achievable. With the thermoplastic urethane mechanical properties the sheave diameter is reducible to 100 millimeters or less. The coating layer 28 defines an engagement surface 30 that is in contact with a corresponding surface of the traction sheave 24.

Figure 9:
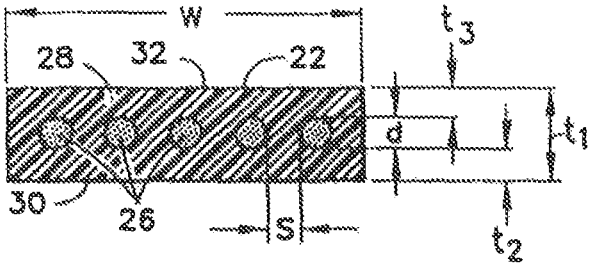
FIG. 9 is a schematic cross sectional view of a flat rope to illustrate various dimensional characteristics thereof.

As shown more clearly in FIG. 9, the tension member 22 has a width w, measured laterally relative to the length of the tension member 22, and a thickness t1, measured in the direction of bending of the tension member 22 about the sheave 24. Each of the cords 26 has a diameter d and are spaced apart by a distance s. In addition, the thickness of the coating layer 28 between the cords 26 and the engagement surface 30 is defined as t2 and between the cords 26 and the opposite surface is defined as t3, such that t1=t2+t3+d.

The overall dimensions of the tension member 22 results in a cross-section having an aspect ratio of much greater than one, where aspect ratio is defined as the ratio of width w to thickness t1 or (Aspect Ratio=w/t1). An aspect ratio of one corresponds to a circular cross-section, such as that common in conventional round ropes. The higher the aspect ratio, the more flat the tension member 22 is in cross-section. Flattening out the tension member 22 minimizes the thickness t1 and maximizes the width w of the tension member 22 without sacrificing cross-sectional area or load carrying capacity. This configuration results in distributing the rope pressure across the width of the tension member 22 and reduces the maximum rope pressure relative to a round rope of comparable cross-sectional area and load carrying capacity. As shown in FIG. 2, for the tension member 22 having five individual cords 26 disposed within the coating layer 28, the aspect ratio is greater than five. Although shown as having an aspect ratio greater than five, it is believed that benefits will result from tension members having aspect ratios greater than one, and particularly for aspect ratios greater than two.

The separation s between adjacent cords 26 is dependant upon the materials and manufacturing processes used in the tension member 22 and the distribution of rope stress across the tension member 22. For weight considerations, it is desirable to minimize the spacing s between adjacent cords 26, thereby reducing the amount of coating material between the cords 26. Taking into account rope stress distribution, however, may limit how close the cords 26 may be to each other in order to avoid excessive stress in the coating layer 28 between adjacent cords 26. Based on these considerations, the spacing may be optimized for the particular load carrying requirements.

The thickness t2 of the coating layer 28 is dependant upon the rope stress distribution and the wear characteristics of the coating layer 28 material. As before, it is desirable to avoid excessive stress in the coating layer 28 while providing sufficient material to maximize the expected life of the tension member 22.

The thickness t3 of the coating layer 28 is dependant upon the use of the tension member 22. As illustrated in FIG. 1, the tension member 22 travels over a single sheave 24 and therefore the top surface 32 does not engage the sheave 24. In this application, the thickness t3 may be very thin, although it must be sufficient to withstand the strain as the tension member 22 travels over the sheave 24. It may also be desirable to groove the tension member surface 32 to reduce tension in the thickness t3. On the other hand, a thickness t3 equivalent to that of t2 may be required if the tension member 22 is used in an elevator system that requires reverse bending of the tension member 22 about a second sheave. In this application, both the upper 32 and lower surface 30 of the tension member 22 is an engagement surface and subject to the same requirement of wear and stress.

The diameter d of the individual cords 26 and the number of cords 26 is dependent upon the specific application. It is desirable to maintain the thickness d as small as possible, as hereinbefore discussed, in order to maximize the flexibility and minimize the stress in the cords 26.

Referring back to FIG. 2, the traction sheave 24 includes a base 40 and a liner 42. The base 40 is formed from cast iron and includes a pair of rims 44 disposed on opposite sides of the sheave 24 to form a groove 46. The liner 42 includes a base 48 having a traction surface 50 and a pair of flanges 52 that are supported by the rims 44 of the sheave 24. The liner 42 is formed from a polyurethane material, such as that described in commonly owned U.S. Pat. No. 5,112,933, or any other suitable material providing the desired traction with the engagement surface 30 of the coating layer 28 and wear characteristics. Within the traction drive 18, it is desired that the sheave liner 42 wear rather than the sheave 24 or the tension member 22 due to the cost associated with replacing the tension member 22 or sheave 24. As such, the liner 42 performs the function of a sacrificial layer in the traction drive 18. The liner 42 is retained, either by bonding or any other conventional method, within the groove 46 and defines the traction surface 50 for receiving the tension member 22. The traction surface 50 has a diameter D. Engagement between the traction surface 50 and the engagement surface 30 provides the traction for driving the elevator system 12. The diameter of a sheave for use with the traction member described hereinabove is dramatically reduced from prior art sheave diameters. More particularly, sheaves to be employed with the flat rope of the invention may be reduced in diameter to 100 mm or less. As will be immediately recognized by those skilled in the art, such a diameter reduction of the sheave allows for the employment of a much smaller machine. In fact, machine sizes may fall to ¼ of their conventional size in for example low rise gearless applications for a typical 8 passenger duty elevators. This is because torque requirements would be cut to about ¼ with a 100 mm sheave and the rpm of the motor would be increased. Cost for the machines indicated accordingly falls.

Although illustrated as having a liner 42, it should be apparent to those skilled in the art that the tension member 22 may be used with a sheave not having a liner 42. As an alternative, the liner 42 may be replaced by coating the sheave with a layer of a selected material, such as polyurethane, or the sheave may be formed or molded from an appropriate synthetic material. These alternatives may prove cost effective if it is determined that, due to the diminished size of the sheave, it may be less expensive to simply replace the entire sheave rather than replacing sheave liners.

The shape of the sheave 24 and liner 42 defines a space 54 into which the tension member 22 is received. The rims 44 and the flanges 52 of the liner 42 provide a boundary on the engagement between the tension member 22 and the sheave 24 and guide the engagement to avoid the tension member 22 becoming disengaged from the sheave 24.

Figure 3:
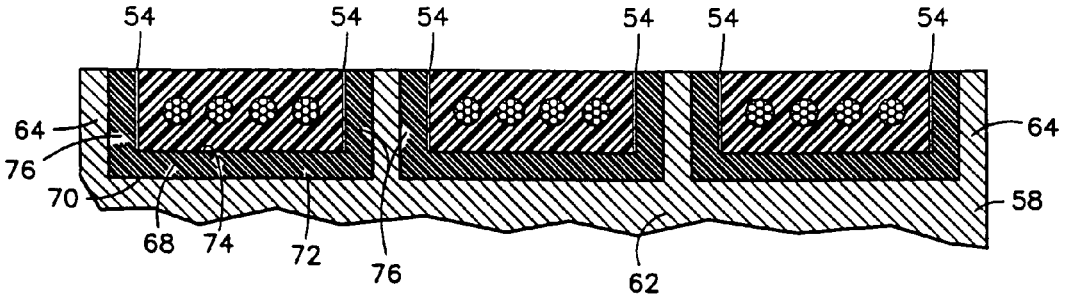
FIG. 3 is a sectional, side view of an alternate embodiment showing a plurality of tension members.

An alternate embodiment of the traction drive 18 is illustrated in FIG. 3. In this embodiment, the traction drive 18 includes three tension members 56 and a traction sheave 58. Each of the tension members 56 is similar in configuration to the tension member 22 described above with respect to FIGS. 1 and 2. The traction sheave 58 includes a base 62, a pair of rims 64 disposed on opposite side of the sheave 58, a pair of dividers 66, and three liners 68. The dividers 66 are laterally spaced from the rims 64 and from each other to define three grooves 70 that receive the liners 68. As with the liner 42 described with respect to FIG. 2, each liner 68 includes a base 72 that defines a traction surface 74 to receive one of the tension members 56 and a pair of flanges 76 that abut the rims 64 or dividers 66. Also as in FIG. 2, the liner 42 is wide enough to allow a space 54 to exist between the edges of the tension member and the flanges 76 of the liner 42.

Figure 4:
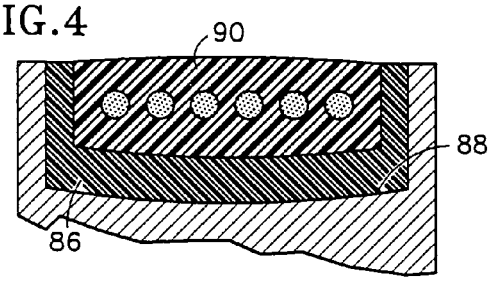
FIG. 4 is another alternate embodiment showing a traction sheave having an convex shape to center the tension member.
Figure 5:
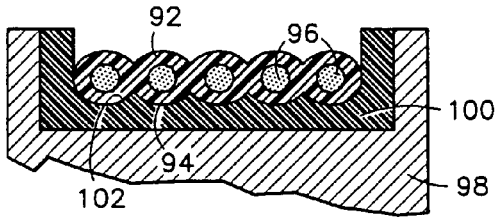
FIG. 5 is a further alternate embodiment showing a traction sheave and tension member having complementary contours to enhance traction and to guide the engagement between the tension member and the sheave.

Alterative construction for the traction drive 18 are illustrated in FIGS. 4 and 5. FIG. 4 illustrates a sheave 86 having a convex shaped traction surface 88. The shape of the traction surface 88 urges the flat tension member 90 to remain centered during operation. FIG. 5 illustrates a tension member 92 having a contoured engagement surface 94 that is defined by the encapsulated cords 96. The traction sheave 98 includes a liner 100 that has a traction surface 102 that is contoured to complement the contour of the tension member 92. The complementary configuration provides guidance to the tension member 92 during engagement and, in addition, increases the traction forces between the tension member 92 and the traction sheave 98.

Use of tension members and traction drives according to the present invention may result in significant reductions in maximum rope pressure, with corresponding reductions in sheave diameter and torque requirements. The reduction in maximum rope pressure results from the cross-sectional area of the tension member having an aspect ratio of greater than one. The calculation for approximate maximum rope pressure (slightly higher due to discreteness of individual cords) is determined as follows:

$$P_{max}=(2F/Dw)$$

Where F is the maximum tension in the tension member. For a round rope within a round groove, the calculation of maximum rope pressure is determined as follows:

$$P_{max}=(2F/Dd)(4/\pi)$$

The factor of $(4/\pi)$ results in an increase of at least 27% in maximum rope pressure, assuming that the diameters and tension levels are comparable. More significantly, the width w is much larger than the cord diameter d, which results in greatly reduced maximum rope pressure. If the conventional rope grooves are undercut, the maximum rope pressure is even greater and therefore greater relative reductions in the maximum rope pressure may be achieved using a flat tension member configuration. Another advantage of the tension member according to the present invention is that the thickness t1 of the tension member may be much smaller than the diameter d of equivalent load carrying capacity round ropes. This enhances the flexibility of the tension member as compared to conventional ropes.

Although the invention has been shown and described with respect to exemplary embodiments thereof, it should be understood by those skilled in the art that various changes, omissions, and additions may be made thereto, without departing from the spirit and scope of the invention.

What is claimed is:

1. A traction drive for an elevator system, the elevator system including a car and a counterweight, the traction drive including a traction sheave driven by a machine and a tension member interconnecting the car and counterweight, the tension member supporting a load of the car and a load of the counterweight, the tension member having a width w, a thickness t measured in the bending direction, said tension member having a plurality of cords therein including wires, each wire being less than 0.25 mm in diameter, said cords being spaced apart in a direction along the width and having a coating material between adjacent cords, said tension member further having an engagement surface defined by the width of the tension member, wherein the tension member has an aspect ratio, defined as the ratio of width w to thickness t, of greater than one, the traction sheave including a traction surface configured to receive the engagement surface of the tension member such that traction between the traction sheave and the engagement surface of the tension member causes movement of the tension member that moves the car and counterweight, wherein the traction sheave includes a pair of retaining rims on opposite sides of the traction sheave, wherein the are of wires arranged in a plurality of strands, each strand having several wires twisted around a center wire, wherein said strands are arranged in a twisted pattern with several strands twisted around a center strand, and wherein said center wire of said center strand in each individual cord is larger than all other wires in each individual cord while having a diameter of less than 0.25 mm.

2. The traction drive of claim 1, wherein said several strands comprise six strands.

3. The traction drive of claim 2, wherein said several strands of each cord consist of six strands.

4. The traction drive of claim 3, wherein said several wires of each strand consist of six wires.

5. The traction drive of claim 1 wherein said several wires comprise six wires.

6. The traction drive of claim 1, wherein said wires are in a range of about 0.10 mm to about 0.20 mm.

7. The traction drive of claim 1, wherein said cords have three distinct sizes of wires.

8. The traction drive of claim 1, wherein said retaining rims provide a boundary on engagement between the tension member and the sheave.

9. The traction drive of claim 1, wherein said cords have three distinct sizes of wires.

10. A traction drive for an elevator system, the elevator system including a car and a counterweight, the traction drive including a traction sheave driven by a machine and a tension member interconnecting the car and counterweight, the tension member supporting a load of the car and a load of the counterweight, the tension member having a width w, a thickness t measured in the bending direction, said tension member having a plurality of cords therein including wires, each wire being of less than 0.25 mm in diameter, said cords being spaced apart in a direction along the width and having a coating material between adjacent cords, said tension member further having an engagement surface defined by the width of the tension member, wherein the tension member has an aspect ratio, defined as the ratio of width w to thickness t, of greater than one, the traction sheave including a traction surface configured to receive the engagement surface of the tension member such that traction between the traction sheave and the engagement surface of the tension member causes movement of the tension member that moves the car and counterweight, wherein the traction sheave includes a pair of retaining rims on opposite sides of the traction sheave, wherein the are wires arranged in a plurality of strands, each strand having several wires twisted around a center wire, wherein said strands are arranged in a twisted pattern with several strands twisted around a center strand, and wherein said center wire in each individual cord is larger than all other wires in each individual cord while having a diameter of less than 0.25 mm.

11. The traction drive of claim 10, wherein said several strands comprise six strands.

12. The traction drive of claim 11, wherein said several strands of each cord consist of six strands.

13. The traction drive of claim 10, wherein said several wires comprise six wires.

14. The traction drive of claim 13, wherein said several wires of each strand consist of six wires.

15. The traction drive of claim 10, wherein said wires are in range of about 0.10 mm to about 0.20 mm.

16. The traction drive of claim 10, wherein said retaining rims provide a boundary on engagement between the tension member and the sheave.

* * * * *